United States Patent [19]

Friedrichs

[11] 4,064,701

[45] Dec. 27, 1977

[54] HYDRAULIC SHIELD ASSEMBLY

[75] Inventor: Hans-Otto Friedrichs, Wuppertal, Germany

[73] Assignee: Herman Hemscheidt Maschinenfabrik, Wuppertal, Germany

[21] Appl. No.: 732,705

[22] Filed: Oct. 15, 1976

[30] Foreign Application Priority Data

Oct. 16, 1975 Germany ..... 2546276

[51] Int. Cl.[2] ..... E21D 15/44

[52] U.S. Cl. ..... 61/45 D; 61/63

[58] Field of Search ..... 61/45 D, 63; 299/31, 299/33; 248/357; 91/170 MP

[56] References Cited

U.S. PATENT DOCUMENTS

| | | | |
|---|---|---|---|
| 3,355,213 | 11/1967 | Seddon | 61/45 D X |
| 3,906,733 | 9/1975 | Koppers | 61/45 D |

FOREIGN PATENT DOCUMENTS

| | | | |
|---|---|---|---|
| 2,051,875 | 4/1972 | Germany | 61/45 D |
| 2,411,040 | 9/1975 | Germany | 61/45 D |
| 240,641 | 12/1969 | U.S.S.R. | 61/45 D |

*Primary Examiner*—Dennis L. Taylor

*Attorney, Agent, or Firm*—Berman, Aisenberg, & Platt

[57] ABSTRACT

An hydraulic shield assembly for use in material-discharging operations in mines, comprising a pivotally-mounted shield which can be raised and lowered by at least one hydraulic prop and which is surmounted by a roof-supporting beam or cap, in which the shield has a forward portion which is more steeply inclined to the horizontal than its rear portion so as to provide a space between that rear portion and the overlying rear portion of the roof-supporting beam or cap in which is supported a pipe for the discharge of material.

4 Claims, 2 Drawing Figures

HYDRAULIC SHIELD ASSEMBLY

This invention relates to an hydraulic shield assembly for use in material-discharging operations in mines, comprising a pivotally-mounted shield which can be raised and lowered by at least one hydraulic prop and which is surmounted by a roof-supporting beam or cap.

Hydraulic shield assemblies have an advantage over traditional truss and chock-type supports in that the face of the mine is sealed off from the space where material-discharging takes place. However, these hydraulic shield assemblies have not hitherto appeared suitable for carrying pneumatic material-discharging pipes which, in the case of truss or chock-type supports, can easily be suspended from the rear portions of the roof-supporting beams or caps. This is because existing shield assemblies have the disadvantage that the space left in the angle between the shield and the rear portion of the roof-supporting beam or cap varies with the height to which the hydraulic prop or props are extended and cannot therefore be used to accommodate a material-discharging pipe.

An aim of the present invention, therefore, is to permit such a pipe to be incorporated in an hydraulic shield assembly.

To this end, according to the invention, an hydraulic shield assembly for use in material-discharging operations in mines comprises a pivotally-mounted shield which can be raised and lowered by at least one hydraulic prop and which is surmounted by a roof-supporting beam or cap, in which the shield has a forward portion which is more steeply inclined to the horizontal than its rear portion so as to provide a space between that rear portion and the overlying rear portion of the roof-supporting beam or cap in which is supported a pipe for the discharge of material.

The advantage of this form of construction is that the material-discharge pipe can now be suspended from the rear portion of the roof-supporting beam or cap and can be reached through at least one closable aperture in the rear portion of the shield. Preferably, by means of a control system acting on an hydraulic ram in or on the said beam or cap, the beam or cap is automatically kept in its correct position with respect to the floor of the mine so that the beam or cap and the penumatic material-discharge pipe cannot tilt even in the case when the mine is being worked on an incline. During operation, other apertures in the rear portion of the shield are kept closed, and are opened only when lateral discharge openings in the pipe are to be used or need maintenance.

Advantageously, according to another preferred feature of the invention, the roof-supporting beam or cap has a fork member or other such projection for connecting it to the shield so that the plane of the beam or cap is offset with respect to a pivotal mounting of the beam or cap on the forward portion of the shield.

Figure 1:
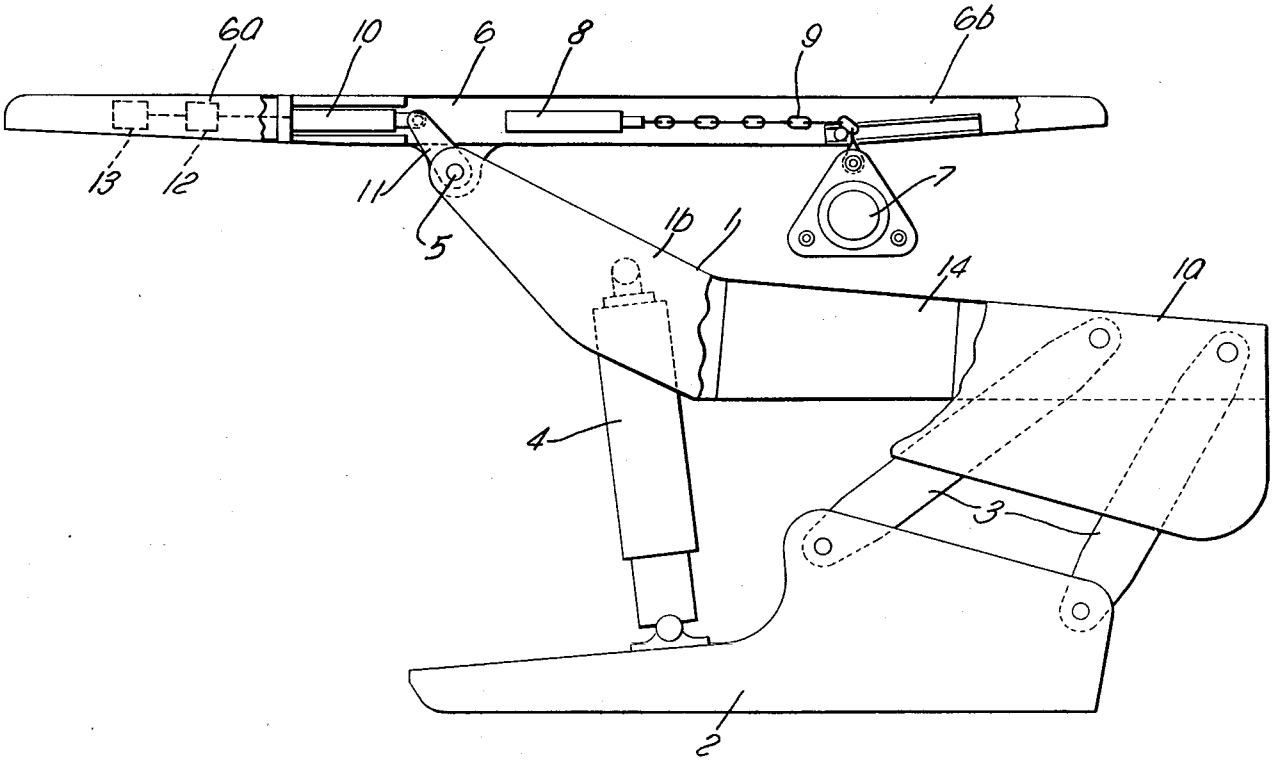
Figure 2:
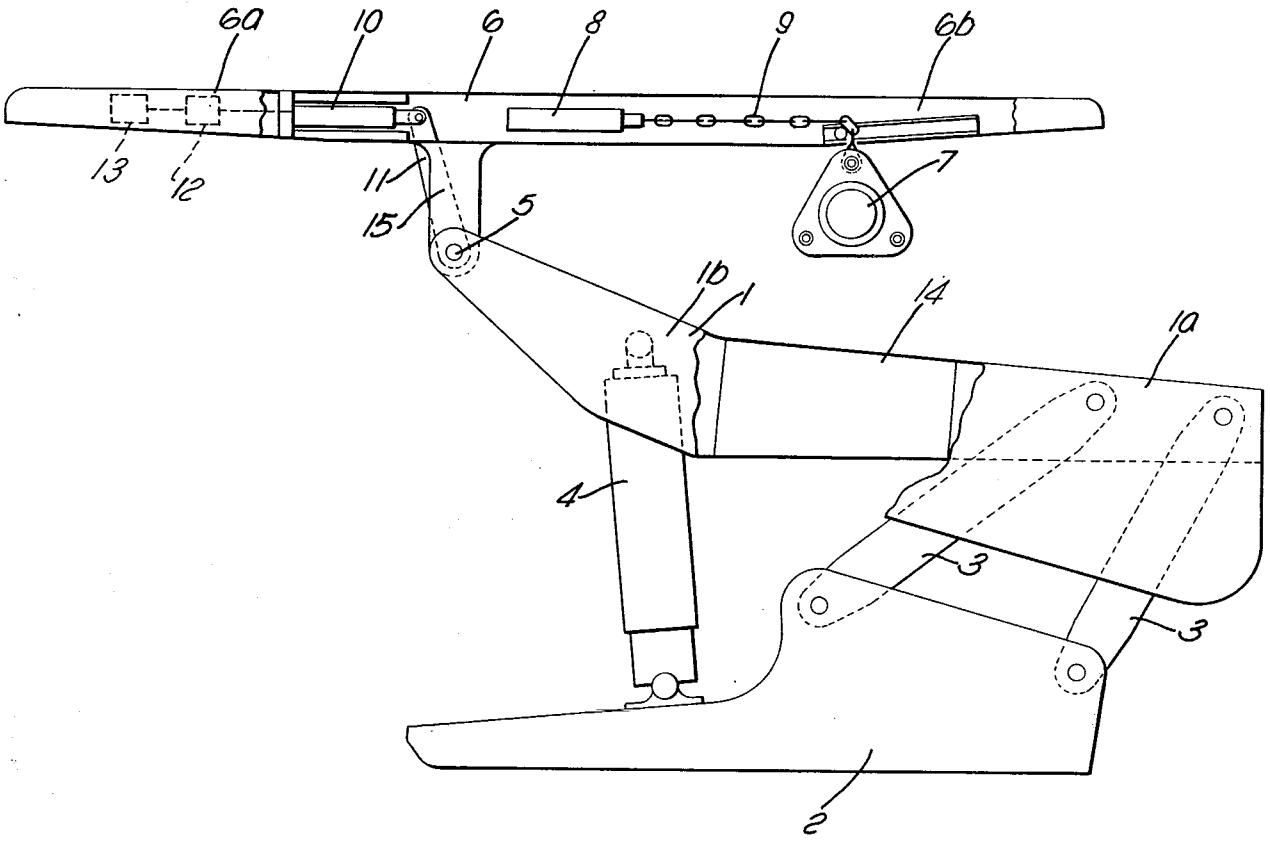

Two examples of hydraulic shield assemblies in accordance with the invention are shown in the accompanying drawings, in which:

FIG. 1 is a side view of one form of hydraulic shield assembly with parts shown in section; and FIG. 2 is a side view, similar to FIG. 1, of another form of hydraulic shield assembly.

The hydraulic shield assembly shown in FIG. 1 comprises a shield 1 which is pivotally supported at its rear portion 1*a* on a floor skid 2 by means of one or more pairs of articulated links 3. The forward portion 1*b* of the shield is supported by one or more hydraulic props 4 which can be vertically extended or retracted to raise or lower the shield 1 respectively.

The forward portion 1*b* of the shield is more steeply inclined to the horizontal than the rear portion 1*a* of the shield (which is only slightly inclined) and rises towards the roof of the mine. A roof-supporting beam or cap 6 is pivoted by the pivot shaft 5 to the upper end of the forward portion 1*b* of the shield. A pneumatic material-discharge pipe 7 is suspended from the rear portion 6*b* of the beam or cap 6 and therefore lies within the space formed between the rear portion 1*a* of the shield and the overlying rear portion 6*b* of the beam or cap 6. By means of an hydraulic cylinder 8 disposed in or on the beam or cap 6, the pneumatic material-discharge pipe 7 is vertically movable on the end of a chain 9 so that it can move at an angle to the direction of advance of the shield 1.

An hydraulic cylinder 10 is mounted in or on the forward portion 6*b* of the beam or cap 6 with its piston rod pivotally connected to an arm 11 secured to the shield 1. The cylinder 10 is controlled by at least one hydraulic control valve 12 which is acted on by a pendulum control device 13, or other attitude-sensitive means, in dependence on the slant of the floor, so that the beam or cap 6 and the pipe 7 are automatically brought into a position substantially parallel to the floor.

Below the rear portion 6*a* of the beam or cap 6, and below the region in which the suspended pipe 7 moves, the rear portion 1*a* of the shield has at least one aperture 14 extending substantially all the way across the shield 1. The aperture permits material to be discharged from the pipe 7 through the aperture and provides access to the pipe 7, more particularly to lateral discharge openings (not shown) in the latter, for inspection and maintenance. Normally the aperture 14 will be closed during operation of the assembly.

The hydraulic shield assembly shown in FIG. 2 is essentially the same as that shown in FIG. 1 except that, for connecting the beam or cap to the shield, a fork member or other projection 15 is secured to the underside of the beam or cap 6 so that the plane of the beam or cap is offset with respect to the pivot shaft 5 on the shield 1.

In the two assemblies described above, the pipes are suspended on the ends of chains 9. These chains could, however, be replaced by cables or other flexible supports.

I claim:

1. An hydraulic shield assembly for use in material-discharging operations in mines, comprising: a generally inclined shield having a front upper end and a rear lower end and having a pronounced bend at an intermediate part between those ends, a floor skid pivotally supporting the shield adjacent the said rear lower end of the shield, at least one hydraulic prop extending between the skid and the shield to raise or lower the shield, a roof-supporting structure pivotally mounted on the front upper end of the shield and extending a substantial distance to the rear of the said front upper end of the shield whereby a rear end of the roof-supporting structure lies vertically above the pivotally-supported rear-end portion of the shield, the portion of the shield to the front of the bend in the shield having top and bottom surfaces both of which are substantially more steeply inclined to the horizontal than top and bottom surfaces on the portion of the shield to the rear of the bend so as to provide a substantial space between the shield and the overlying rear portion of the roof-supporting structure at all positions of the shield, and a pipe for the discharge of material supported in that space by the roof-supporting structure.

2. An hydraulic shield assembly according to claim 1, in which the pipe is supported by the roof-supporting structure through a flexible support connected to an hydraulic cylinder forming part of the roof-supporting structure.

3. An hydraulic shield assembly according to claim 1, in which the portion of the roof-supporting structure to the front of the front upper end of the shield contains an hydraulic ram having a piston rod pivotally connected to an arm secured to the front upper end of the shield, the supply of hydraulic fluid to the said hydraulic ram being controlled by at least one hydraulic control valve which is acted on by attitude-sensitive means, in dependence on the slant of the floor on which the floor skid rests, to open and close the valve and thus cause the said hydraulic ram in the roof-supporting structure to bring the latter structure into a position substantially parallel to the floor.

4. An hydraulic shield assembly according to claim 1, in which the roof-supporting structure includes a downwardly-extending projection for connecting the said structure to the upper front end of the shield so that the general plane of the said structure is vertically offset with respect to the pivotal mounting of the said structure on the shield.

* * * * *